US009064618B2

(12) United States Patent
Kuchta et al.

(10) Patent No.: US 9,064,618 B2
(45) Date of Patent: Jun. 23, 2015

(54) ELECTRICAL CABLE WITH SEMI-CONDUCTIVE OUTER LAYER DISTINGUISHABLE FROM JACKET

(75) Inventors: Frank Kuchta, Lexington, SC (US); Patrick Coplen, Lexington, SC (US); Gonzalo Chavarria, Lexington, SC (US); Nathan Kelley, Lexington, SC (US)

(73) Assignee: Prysmian Power Cables and Systems USA, LLC, Lexington, SC (US)

( * ) Notice: Subject to any disclaimer, the term of this patent is extended or adjusted under 35 U.S.C. 154(b) by 188 days.

(21) Appl. No.: 13/699,999

(22) PCT Filed: May 27, 2010

(86) PCT No.: PCT/US2010/036314

§ 371 (c)(1),
(2), (4) Date: Mar. 8, 2013

(87) PCT Pub. No.: WO2011/149463

PCT Pub. Date: Dec. 1, 2011

(65) Prior Publication Data

US 2013/0168126 A1 Jul. 4, 2013

(51) Int. Cl.

| | |
|---|---|
| ***H01B 1/00*** | (2006.01) |
| ***H01B 7/18*** | (2006.01) |
| ***H01B 7/295*** | (2006.01) |

(Continued)

(52) U.S. Cl.

CPC ..... *H01B 7/361* (2013.01); *H01B 9/027* (2013.01)

(58) Field of Classification Search

CPC ..... H01B 9/027; H01B 9/02; C08J 2323/06
USPC ..... 174/102 SC, 105 SC, 110 R
See application file for complete search history.

(56) References Cited

U.S. PATENT DOCUMENTS

| | | | | |
|---|---|---|---|---|
| 3,168,417 | A * | 2/1965 | Smith, Jr. et al. | 428/383 |
| 3,433,891 | A * | 3/1969 | Zysk et al. | 174/120 R |
| 3,516,859 | A | 6/1970 | Gerland et al. | |

(Continued)

FOREIGN PATENT DOCUMENTS

| | | |
|---|---|---|
| CN | 101379126 A | 3/2009 |
| EP | 0 802 542 A2 | 10/1997 |

(Continued)

OTHER PUBLICATIONS

International Search Report from the European Patent Office for International Application No. PCT/US2010/036314, mailing date Feb. 16, 2011.

(Continued)

*Primary Examiner* — Timothy Thompson
*Assistant Examiner* — Sherman Ng
(74) *Attorney, Agent, or Firm* — Finnegan, Henderson, Farabow, Garrett & Dunner, L.L.P.

(57) ABSTRACT

An electrical power cable has an outer semi-conductive layer extruded around and in contact with an outermost layer of a cable jacket. The jacket may have a plurality of polymeric layers. The semi-conductive layer is distinguishable from the outermost layer of the jacket immediately underneath it by at least color and possibly also texture. The distinguishable characteristics between the semi-conductive layer and the outermost layer of the jacket decrease the risk of inadvertent damage to the jacket when removing the semi-conductive layer for jacket integrity tests.

16 Claims, 2 Drawing Sheets

(51) Int. Cl.
*H01B 7/36* (2006.01)
*H01B 9/02* (2006.01)

(56) References Cited

U.S. PATENT DOCUMENTS

| | | | | |
|---|---|---|---|---|
| 3,651,244 | A * | 3/1972 | Silver et al. | 174/36 |
| 3,876,462 | A * | 4/1975 | Carini et al. | 428/367 |
| 4,010,315 | A * | 3/1977 | Mildner | 174/107 |
| 4,986,372 | A | 1/1991 | Ganssle | |
| 5,144,098 | A | 9/1992 | VanDeusen | |
| 5,281,757 | A * | 1/1994 | Marin et al. | 174/23 R |
| 5,521,331 | A * | 5/1996 | Hillburn | 174/36 |
| 5,719,353 | A * | 2/1998 | Carlson et al. | 174/28 |
| 6,005,192 | A * | 12/1999 | Mashikian et al. | 174/110 R |
| 6,086,792 | A * | 7/2000 | Reid et al. | 252/511 |
| 6,197,219 | B1 | 3/2001 | Foulger | |
| 6,277,303 | B1 | 8/2001 | Foulger | |
| 6,284,832 | B1 | 9/2001 | Foulger et al. | |
| 6,417,265 | B1 | 7/2002 | Foulger | |
| 6,455,769 | B1 * | 9/2002 | Belli et al. | 174/23 C |
| 6,506,492 | B1 * | 1/2003 | Foulger | 428/372 |
| 6,569,937 | B2 | 5/2003 | Foulger et al. | |
| 6,717,058 | B2 | 4/2004 | Booth et al. | |
| 7,208,682 | B2 | 4/2007 | Kuchta et al. | |
| 7,767,910 | B2 | 8/2010 | Kjellqvist et al. | |
| 2003/0111253 | A1 * | 6/2003 | Easter | 174/110 R |
| 2004/0154823 | A1 * | 8/2004 | Amato | 174/113 R |
| 2006/0254801 | A1 * | 11/2006 | Stevens | 174/102 R |
| 2007/0181333 | A1 | 8/2007 | Belli et al. | |
| 2008/0283273 | A1 * | 11/2008 | Nam et al. | 174/110 PM |
| 2008/0314613 | A1 * | 12/2008 | Huang et al. | 174/107 |
| 2009/0056793 | A1 | 3/2009 | Kjellqvist et al. | |

FOREIGN PATENT DOCUMENTS

| | | | |
|---|---|---|---|
| WO | WO 03/046592 | A1 | 6/2003 |
| WO | WO 2005/015576 | A1 | 2/2005 |
| WO | WO 2007/092454 | A1 | 8/2007 |

OTHER PUBLICATIONS

English-language translation of Notification of the First Office Action issued by the State Intellectual Property Office of the People's Republic of China on Sep. 23, 2014 in corresponding Application No. CN 201080067420.1 (11 pages).

"Standard for Extruded Insulation Power Cables Rated Above 46 Through 345 KV", Publication No. ANSI/ICEA S-108-720-2004, pp. 1-77, (2004).

* cited by examiner

ELECTRICAL CABLE WITH SEMI-CONDUCTIVE OUTER LAYER DISTINGUISHABLE FROM JACKET

TECHNICAL FIELD

The present invention relates to an electrical cable, such as a medium voltage or high voltage cable for electric power transmission or distribution. More specifically, the present invention relates to an electrical power cable having an extruded outer semi-conductive layer visually or physically distinguishable from an underlying protective jacket.

BACKGROUND

The structure of electrical power cables may vary according to the voltages used in their intended applications. In general, electrical power cables may be categorized as low voltage, medium voltage, or high voltage. Typically, "low voltage" means a voltage up to 5 kV, "medium voltage" means a voltage of from 5 kV to 46 kV, and "high voltage" means a voltage greater than 46 kV.

Medium and high voltage power cables include four major elements. From interior to exterior, these power cables include at least an electrical conductive element, an electrical insulation layer, a metallic screen or sheath layer, and a jacket. Additional layers may also be present. One example is a semi-conductive conductor shield between the conductive element and the electrical insulation layer. Another example is a semi-conductive insulation shield between the electrical insulation layer and the metallic screen or sheath layer.

In the present description and claims, an "insulated cable core" means the interior of an electrical power cable under the jacket and comprising at least one conductive element, at least one insulation layer, and a metallic screen or sheath layer.

The thickness of each of the layers in an insulated cable core is determined by voltage rating and conductor size and is specified by industry standards such as those published by the Insulated Conductors Engineering Association (ICEA), the Association of Edison Illuminating Companies (AEIC), and Underwriters Laboratories (UL). Electrical cable performance criteria are specified and tested according to AEIC and ICEA standards.

The term "conductive element" may mean a conductor of the electrical type or of the mixed electrical/optical type. An electrical type conductor may be made of copper, aluminum, or aluminum alloy. Also, an electrical type conductor may be either solid or stranded metal, with stranding adding flexibility to the cable. If stranded, the electrical type conductor for medium voltage cables and often also for high voltage cables often includes strand seal to fill its interstices, which helps prevent water migration along the conductor. A mixed electrical/optical type conductor may comprise mixed power/telecommunications cables, which include an optical fiber element in addition to the electrical conductive element for telecommunication purposes.

An inner semi-conductive layer typically surrounds the electrical conductor. The inner semi-conductive layer is most often a semiconducting crosslinked polymer layer applied by extrusion around the conductive element.

Arranged in a position radially external to the inner semi-conductive layer, an electrical insulation layer is usually made of a thermoplastic or thermoset material. Examples include crosslinked polyethylene (XLPE), ethylene-propylene rubber (EPR), or polyvinyl chloride (PVC). The insulation layer may include additives to enhance the life of the insulation. For example, tree retardant additives are often added to XLPE to inhibit the growth of water trees in the insulation layer.

An intermediate semi-conductive layer made, for example, of a semiconducting polymer, can be extruded over the insulation layer. The intermediate semi-conductive layer is usually adhered to the insulation layer by extrusion, or, particularly for certain high voltage cables, may be bonded to the insulation layer by other means.

A metallic shield overlaying the insulation shield may comprise a metallic screen or sheath layer. Usually, metallic screen or sheath layer is made of aluminum, steel, lead, or copper. In general, the metallic screen or sheath layer is a continuous tubular component or a metallic sheet folded on itself and welded or sealed to form the tubular component. More particularly, the metallic shield may be formed, for example, as a longitudinally applied corrugated copper tape with an overlapped seam or welded seam, helically applied wires (i.e. drain wires or concentric neutral wires), or flat copper straps. The intermediate semi-conductive layer is advantageously in electrical contact with the metallic shield.

For the purposes of the present description, the expression "unipolar cable" means a cable provided with an insulated cable core having a single conductive element as defined above, while the expression "multipolar cable" means a cable provided with at least one pair of conductive elements. In greater detail, when the multipolar cable has a number of conductive elements equal to two, the cable is technically defined as being a "bipolar cable," if there are three conductive elements, the cable is known as a "tripolar cable," and so on.

In the case of a multipolar cable for medium voltage power transmission or distribution, the conductive elements of the cable, each surrounded by semi-conductive and insulating layers and a metal sheath discussed above, are generally combined together, for example by means of a helical winding of predetermined pitch. The winding results in the formation of a plurality of interstitial zones, which are filled with a filling material. The filling material serves to give the multipolar cable a circular cross section. The filling material may be of conventional type, for example a polymeric material applied by extrusion, or may be an expanded polymeric material.

U.S. Pat. No. 5,281,757, herein incorporated by reference, discloses an example of an insulated cable core for an electrical power cable. In the '757 patent, an electrical power cable has a stranded conductor, a semi-conductive stress control layer around the conductor, a layer of insulation around the stress control layer, a semi-conductive insulation shield layer around the layer of insulation, and an imperforate metal strip with overlapping edge portions around the shield layer. The strip is free to move with respect to the jacket and the shield layer with expansion and contraction of the cable elements with temperature changes. The overlapping edge portions of the strip are bonded together by an adhesive which permits the edge portions to move relative to each other with such temperature changes without creating fluid passageways between the edge portions.

Electrical power cables may include a protective jacket arranged radially external to the insulated cable core. The jacket is typically a polymeric material applied by extrusion.

Any defect in and/or damage to the protective jacket of the cable constitutes a discontinuity in the polymeric layer, which may give rise to problems that reduce, even drastically, the cable's capacity for power transmission and distribution, and also the cable's life. For example, the presence of an incision in the jacket of the cable represents a preferential route for the entry of water or moisture to the interior (that is to say towards the core) of the cable.

The entry of water into a cable is particularly undesirable since, in the absence of suitable solutions provided to stop the leak, once the water has entered, it is able to run freely inside the cable. This particularly causes damages in terms of the integrity of the cable, since corrosion problems (affecting, for example, the armoring, if present, or the metal screen) may arise inside the cable, as well as problems of premature ageing with degradation of the electrical properties of the insulating layer. This phenomenon of premature ageing is better known with the term "water treeing" and is manifested by the formation of micro-fractures of branched shape ("trees") due to the combined action of the electrical field generated by the passage of current in the conductor, and of the moisture that has penetrated into the insulating layer.

Testing methods used to evaluate the structural integrity of the protective jacket of an electrical cable are called jacket integrity tests. These tests involve installing an electrically conductive or semi-conductive layer placed in a position radially external to the jacket.

One jacket integrity test is known as the DC withstand test and may be conducted according to methods known in the art, such as the ICEA (Insulated Cable Engineers Association, Inc.) Standard S-108-720-2004 for Extruded Insulation Power Cables Rated Above 46 Through 345 kV (Section E5.2). In the test, a semi-conductive coating, such as a layer of graphite in liquid or solid form, is applied to the jacket and serves as a first electrode. The second electrode is represented by the metal component arranged in a radially internal position relative to the sheath to be tested, such as the metal screen or sheath. A DC voltage of about 150 V/mil (6 kV/mm) and up to a maximum of 24 kV is applied between the metallic screen and the semi-conductive layer to verify the integrity of the outer jacket dielectric.

In the absence of defects and/or damages, the jacket is capable of withstanding the voltage applied between the electrodes. That is, in the absence of defects in and/or damages to the jacket, the voltage measured according to a relevant standard at the end of the cable that is opposite to the end at which the DC voltage is applied between the first and second electrodes will be substantially unchanged relative to the applied voltage. This result will occur because the electrical current will be able to pass undisturbed in the semi-conductive coating and in the metal component immediately below the jacket from one end of the cable to the other, apart from a small reduction in voltage due to the resistance of the jacket.

If, however, the jacket has a defect and/or damage such as to create an electrically conductive path in the thickness of the jacket between the electrodes in the test, a short-circuit condition will exist and an overcurrent will be produced. The establishment of the overcurrent condition thus enables a person skilled in the art to confirm the presence of damage to and/or a defect in the protective jacket of the cable.

In general, the DC withstand test of the jacket is performed directly at the production plant after the process for producing the cable. Sometimes, the DC withstand test is also repeated once the cable has been installed, so as to check for any evidence of damage produced in the outer jacket due to the laying operations of the cable. Repeating the testing once the cable has been installed is desirable, especially in the case of underground installations in which the electrical cable is placed directly in the ground without the aid of conduits to contain it.

Graphite has traditionally been used for the outer semi-conductive layer because it can be easily removed at one end of the cable, as is required for conducting the DC withstand test. However, after the cable has been buried, graphite may offer problems during maintenance testing because the graphite is messy and it may have rubbed off during installation.

Instead of applying graphite around the jacket, a thin layer of semi-conductive polymeric material may alternatively be extruded over the jacket. A discussion of various semi-conductive materials can be found for example in the Background section of U.S. Pat. No. 7,208,682, which is incorporated herein by reference for that subject. Typically, the jacket and the outer semi-conductive layer are co-extruded, which bonds them together. As a result, the semi-conductive layer does not buckle due to friction or sidewall bearing forces during installation.

Another benefit to co-extruding the two layers is that the semi-conductive layer can help contribute to sunlight resistance of the cable. Although the semi-conductive layer over the outer cable jacket is not generally relied on for sunlight resistance, depending on its thickness, the semi-conductive layer could impart more sunlight resistance to the cable. Industry standards, for example ICEA S-108-720-2004 (Section 7.3), provide for an extruded semi-conductive layer over the jacket in a thickness up to 20% of the combined wall thickness of the semi-conductive layer and the jacket. Thus, a sufficiently thick semi-conductive layer would be able to impart sunlight resistance to the cable.

While the outer jacket of an electrical power cable is typically black, it is known to make the jacket non-black for particular applications. In these situations, which are more expensive to manufacture, customers request different colored jackets in order to identify one cable from another. When colored jackets are used, a semi-conductive layer is not applied over the jacket, as it defeats the purpose of the colored jacket.

WO 03/046592, which is incorporated by reference, relates to a modified electrical cable in which a semi-conductive polymeric layer is arranged in a position radially external to the outer protective polymeric sheath that coats the cable. In particular, the cable comprises a semi-conductive polymeric layer in a position radially external to the protective polymeric layer. The thickness of the semi-conductive polymeric layer is preferably between 0.05 mm and 3 mm and more preferably between 0.2 mm and 0.8 mm. In the examples, the outer protective sheath is made of MDPE with a thickness of 1.8 mm and is deposited on the cable thus obtained by extrusion; a semi-conductive polymeric layer is deposited on the outer protective sheath, by extrusion, with a thickness of 1 mm. The semi-conductive polymeric layer is disclosed as possibly being a foamed material.

Other cables are known with semi-conductive jackets. For example, U.S. Pat. No. 5,144,098 discloses a conductively-jacketed electrical cable, which provides continuous electrical contact from a drain wire through a metal-coated tape wrapped shield, a semi-conductive adhesive layer applied to the tape on the reverse side from the metal coating, and a semi-conductive outer jacket. The semi-conductive outer jacket is a conductive carbon-filled polymer material such as a thermoplastic fluoropolymer.

U.S. Pat. No. 4,986,372 discloses an electric cable that may include an optional outer jacket, which is substantially cylindrical, and may be composed of either an insulating non-conductive material or a semi-conductive material, for example low density polyethylene, linear low density polyethylene, semi-conducting polyethylene, or polyvinyl chloride.

As mentioned above, the semi-conductive material layer, whether made of graphite or of an extruded polymer material, must be removed at either end of the cable at the beginning of the DC withstand test. Additionally, the semi-conductive layer must be removed from joints and splices.

Applicant has found that the conventional approaches to co-extruding a semi-conductive polymeric layer with the polymeric jacket can lead to problems when removing the semi-conductive material layer to perform the DC withstand test. In particular, Applicant has observed that the jacket and the outer semi-conductive layer lack attributes to make them sufficiently distinguishable from each other to a worker in the field.

The co-extruded jacket and outer semi-conductive layer are both generally black. As discussed above, the jacket may be a color other than black in special circumstances to help distinguish one cable from another, but not when the cable includes an outer semi-conductive layer. The jacket is also black to aid with sunlight resistance. The semi-conductive layer may be black in color from the conductive filler, which is often carbon black. Therefore, due to the color similarity between the jacket and the outer semi-conductive layer, Applicant has found that it is difficult for a worker to distinguish the two layers from each other by sight.

U.S. Pat. No. 6,717,058 discloses a multi-conductor cable with a twisted pair section and a parallel section, wrapped in a transparent plastic jacket to form a generally uniform round-shaped cable. The transparent jacket allows the flat section to be identified so that the jacket may be removed at this location and the conductors in the flat section prepared for attachment to a connector. The cable of the '058 patent is concerned with communication cables having twisted pairs and not with electrical power cables traditionally having a black jacket, required sunlight resistance, or jacket integrity tests.

Accordingly, Applicant has observed that, in the absence of sufficient distinguishing visual characteristics between the jacket and the outer semi-conductive layer of an electrical power cable, a worker may damage the underlying jacket when attempting to remove a portion of the semi-conductive layer to perform a test like the DC withstand one. Damaging the jacket needs to be avoided because, as discussed above, a defect in and/or damage to the jacket can constitute a discontinuity, which may reduce the cable's capacity for power transmission and distribution and the cable's life.

For the purpose of the present description and of the appended claims, except where otherwise indicated, all numbers expressing amounts, quantities, percentages, and so forth, are to be understood as being modified in all instances by the term "about." Also, all ranges include any combination of the maximum and minimum points disclosed and include any intermediate ranges therein, which may or may not be specifically enumerated herein.

SUMMARY

Electrical power cables should be amenable to tests on the integrity of the cable's jacket without the risk of additional damage being imparted to the jacket when preparing the cable for the integrity tests. Applicant has found that an electrical power cable with a semi-conductive layer extruded around the exterior of the cable in which the semi-conductive layer is visually distinguishable from a polymeric layer immediately underneath it by color, and alternatively also texture, may decrease the risk of inadvertent damage to a jacket underlying the semi-conductive layer.

In accordance with one embodiment, an electrical cable includes an insulated core, a jacket surrounding the insulated core having at least an outermost polymeric layer, and a semi-conductive layer around the exterior of the cable in contact with the outermost polymeric layer of the jacket. The semi-conductive layer is different in color from the outermost polymeric layer of the jacket.

The insulated core of the cable may include a metallic conductor, an inner semi-conductive shield surrounding the conductor, a layer of extruded insulation around the inner semi-conductive shield, an intermediate semi-conductive shield around the extruded insulation, and a metallic screen surrounding the intermediate semi-conductive shield. In one embodiment, the insulated core is a multipolar cable comprising more than one conductor.

The jacket is preferably made of low density polyethylene (LDPE), medium density polyethylene (MDPE), high density polyethylene (HDPE), polyvinyl chloride (PVC), or a low smoke zero halogen (LSOH) material. In one aspect, the jacket is monolayered with the outermost polymeric layer being its only layer. Alternatively, the jacket may have two or more polymeric layers, one being an innermost polymeric layer and another being the outermost polymeric layer.

In one embodiment of the electrical cable, the semi-conductive layer may be black in color, while the outermost polymeric layer of the jacket is a color other than black. Preferably, the outermost polymeric layer is the natural color of the polymeric material without the addition of any colorants, and the semi-conductive layer is a polymer loaded with carbon black. The polymer of the semi-conductive layer may be, for example, low density polyethylene (LDPE), linear low density polyethylene (LLDPE), medium density polyethylene (MDPE), or ethylene vinyl acetate (EVA). The semi-conductive layer preferably has a thickness up to 20% of the combined thicknesses of the semi-conductive layer and the jacket. This may impart improved sunlight resistance to the cable.

In another embodiment, the semi-conductive layer is of a color other than black, and the outermost polymeric layer of the jacket is black. The semi-conductive layer may be at least a material selected from the group of conductive polymers consisting essentially of polyaniline, polypyrrole and polyacetylene. Preferably, the semi-conductive layer includes UV additives to improve sunlight resistance.

Either the semi-conductive layer or the outer polymeric layer may also be made of a foamed material formed from expansion during extrusion. The layer of foamed material has a surface texture rougher than the unfoamed layer it abuts, making the outermost polymeric layer of the jacket and the outer semi-conductive layer distinguishable from each other by color and/or texture.

It is to be understood that both the foregoing general description and the following detailed description are exemplary and explanatory only and are not restrictive of the invention, as claimed.

The accompanying drawings as summarized below, which are incorporated in and constitute a part of this specification, illustrate embodiments of the invention and together with the description, serve to explain the principles of the invention.

DESCRIPTION OF THE EMBODIMENTS

Figure 1:
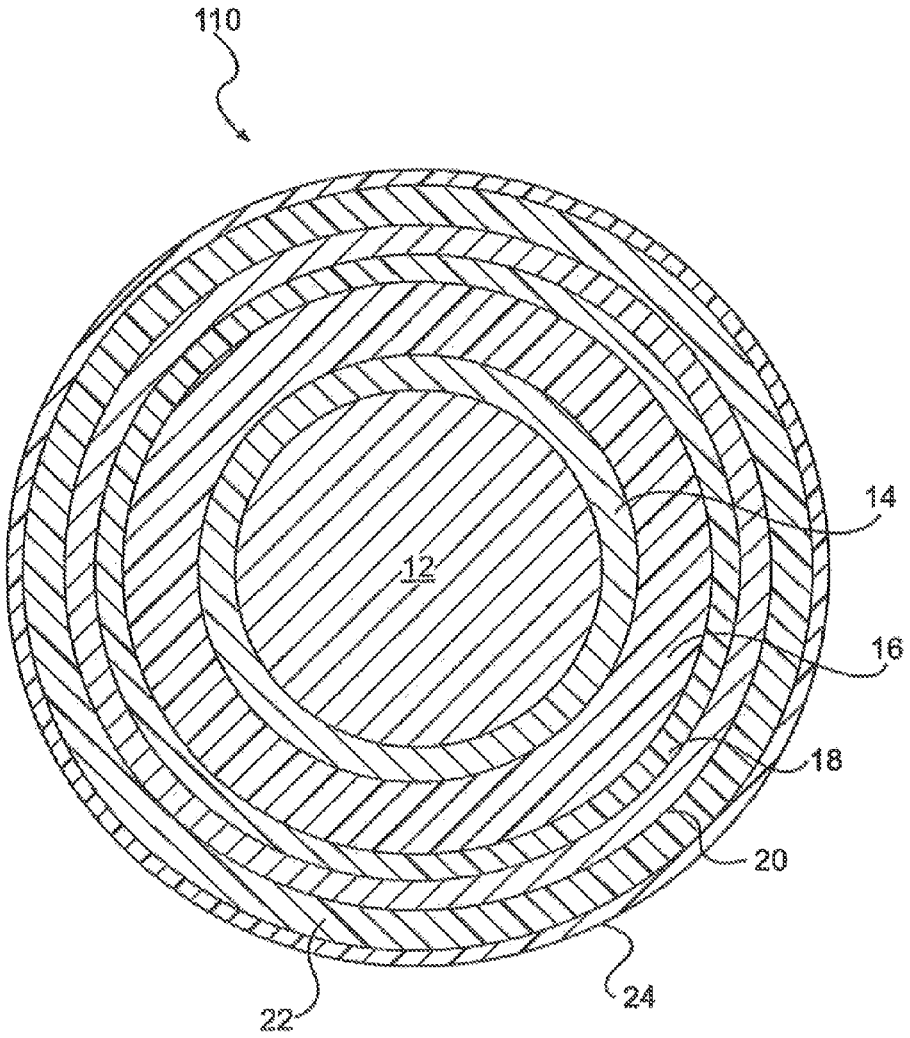
FIG. 1 is a cross-sectional view of an electrical cable having a two-layer sheath, consistent with certain disclosed embodiments.

Reference will now be made in detail to the present exemplary embodiments of the invention, examples of which are illustrated in the accompanying drawings. The present disclosure, however, may be embodied in many different forms and should not be construed as limited to the embodiments set forth herein. In the drawings, wherever possible, like numbers refer to like elements.

Referring now to FIG. 1, an electrical cable 110 has at its interior an insulated cable core comprising a conductor 12, an extruded inner semi-conductive layer 14 encircling the conductor 12, an extruded layer of electrical insulation 16 surrounding the inner semi-conductive layer 14, an extruded intermediate semi-conductive layer 18 over the layer of electrical insulation 16, and a metallic screen 20 over the intermediate semi-conductive layer 18. Additional components such as water swellable conductive or non-conductive tapes, rip cords, and the like may be included in the insulated cable core, as is known in the art. The optional water swellable tape may be capable of acting as a barrier to the penetration of water into the insulated core of the cable.

Although shown in FIG. 1 as a unipolar cable, electrical cable 110 can alternatively be a multipolar cable, such as a bipolar or a tripolar cable. For simplicity, the following description of FIG. 1 addresses a unipolar structure for cable 110, and it will be understood by those skilled in the art that such description would apply equally to a multipolar cable if desired.

Conductor 12 may be a conductor of the electrical type or of the mixed electrical/optical type. A electrical type conductor may be made of copper, aluminum, or aluminum alloy. Although shown in FIG. 1 as a single element, conductor 12 may be either solid or stranded, with stranding adding flexibility to cable 110. If stranded, the electrical type conductor often includes strand seal to fill its interstices, which helps prevent water migration along the conductor. A mixed electrical/optical type conductor may comprise mixed power/telecommunications cables, which include one or more optical fibers as part of the conductor element 12.

Inner semi-conductive layer 14 encircling conductor 12 may comprise any material known to those skilled in the art for semi-conductive shields and is typically extruded over conductor 12. Preferably, layer 14 is a thermoplastic or thermoset compound based on polyethylene compounds such as ethylene/butyl acrylate (EBA), ethylene/ethyl acrylate (EEA), ethylene/methyl acrylate (EMA), and ethylene/vinyl acetate (EVA). Additionally, layer 14 may comprise "double percolation" thermoplastic and thermoset (cross-linked) materials as described in U.S. Pat. Nos. 6,569,937, 6,417,265, and 6,284,832 (thermoset materials) and U.S. Pat. Nos. 6,277,303 and 6,197,219 (thermoplastic materials), each of which is incorporated by reference for its teachings relative to double percolation.

Electrical insulation layer 16 surrounds the inner semi-conductive layer 14. An electrical insulation layer 16 is typically applied by extrusion and provides electrical insulation between conductor 12 and the closest electrical ground, thus preventing an electrical fault. Electrical insulation layer 16 may be a crosslinked or non-crosslinked polymeric composition with electrical insulation properties, which is known in the art and may be chosen, for example, from: polyolefins (homopolymers or copolymers of various olefins), olefin/ethylenically unsaturated ester copolymers, polyesters, polyethers, polyether/polyester copolymers, and blends thereof. Examples of such polymers are: polyethylene (PE), such as linear low-density polyethylene (LLDPE); polypropylene (PP); propylene/ethylene thermoplastic copolymers; ethylene-propylene rubbers (EPR) or ethylene-propylene-diene rubbers (EPDM); natural rubbers; butyl rubbers; ethylene/vinyl acetate (EVA) copolymers; ethylene/methyl acrylate (EMA) copolymers; ethylene/ethyl acrylate (EEA) copolymers; ethylene/butyl acrylate (EBA) copolymers; ethylene/a-olefin copolymers, and the like. An exemplary thickness for electrical insulation layer 16 is 3 to 30 mm.

Intermediate semi-conductive layer 18, which is typically applied by extrusion, encircles the layer of electrical insulation 16 and may comprise any material known to those skilled in the art for semi-conductive shields. In particular, the composition of layer 18 may be selected from the same options of materials for inner semi-conductive layer 14, as described above.

Metallic screen 20 is formed around intermediate semi-conductive layer 18 and may be copper concentric neutral wires, aluminum, steel, lead, or copper or aluminum laminated tape, or both. Metallic screen 20 can be a tape, which is longitudinally folded or spirally twisted to form a circumferentially and longitudinally continuous layer, in a manner well known in the art. Metallic screen 20 may be a continuous tubular component or a metal sheet folded on itself and welded or sealed to form the tubular component. In this way, the metallic screen has several functions. First, it ensures leak tightness of the cable to any water penetration in the radial direction. And second, the screen creates a uniform electrical field of the radial type inside the cable. In addition, the screen can support any short-circuit currents that may arise.

In accordance with several disclosed embodiments, electrical cable 110 of FIG. 1 further includes an outer sheath surrounding the insulated cable core and having a plurality of polymeric layers. The polymeric layers may be extruded over metallic screen 20 and, preferably, are extruded substantially simultaneously (i.e., co-extruded) over screen 20.

As depicted in FIG. 1, the outer sheath first includes a jacket 22 formed around the insulated core. Jacket 22 is preferably a polymeric material and may be formed through pressure extrusion. Jacket 22 serves to protect the cable from environmental, thermal, and mechanical hazards and substantially encapsulates the insulated cable core. When extruded, jacket 22 flows over the insulated cable core. Jacket thickness may depend on factors such as cable rating and conductor size and is identified in industry specifications, as well known to those skilled in the art. As a general guide, the thickness of jacket 22 may be in the range of 70-180 mils (1.78-4.57 mm). The thickness of the jacket 22 results in an encapsulated sheath that stabilizes the insulated cable core and maintains uniform neutral spacing for current distribution.

The jacket 22 may be made one or more of a variety of materials well known and used in the art for electrical power cables. For example, jacket 22 may be low density polyethylene (LDPE), medium density polyethylene (MDPE), high density polyethylene (HDPE), polyvinyl chloride (PVC), or a low smoke zero halogen (LSOH) material.

Referring to FIG. 1, an outer semi-conductive layer 24 also applied by extrusion surrounds and contacts jacket 22. Semi-conductive layer 24 includes conductive material, described below, that enables it to be used for performing a DC withstand test on jacket 22.

According to one embodiment, the outer semi-conductive layer 24 surrounding jacket 22 may be distinguished from jacket 22 by color. In the situation where jacket 22 is a conventional black color, the outer semi-conductive layer 24 surrounding jacket 22 is a color other than black. For instance, semi-conductive layer 24 may include conductive material such as polyaniline, which provides a non-black color when extruded. Polyaniline, depending on its conductivity, may be green, white, clear, blue, or violet in appearance. Other examples of potential conductive materials for semi-conductive layer 24 that result in a non-black extruded polymer are polypyrrole and polyacetylene.

The resulting color difference between the black jacket 22 and the non-black semi-conductive layer 24 helps to make the two layers distinguishable from each other to a field technician. When cutting off a portion of the semi-conductive layer 24, the technician can readily detect the boundary between the semi-conductive layer 24 and the different material underlying it. Therefore, the technician is able to avoid inadvertently cutting or otherwise damaging jacket 22.

Conversely, semi-conductive layer 24 can be made distinguishable from the material immediately underlying it by making the semi-conductive layer 24 black in color and making the underlying material a color other than black. For example, the thin semi-conductive layer 24 surrounding the jacket may be extruded from a carbon black-loaded polymer. Jacket 22, which is preferably formed simultaneously by co-extrusion with the semi-conductive layer 24, may be formed of a non-black polymer, such as one being natural in color. Jacket layer 22 may be made from a natural, uncolored polyethylene material having UV additives for sunlight resistance, such as DHDA-8864 NT available from Dow Chemical Company and ME6053 and HE6068 available from Borealis AG. Making a jacket that is non-black contradicts conventional industry practice calling for black jackets in applications that include an outer semi-conductive layer.

Semi-conductive layer 24 may be a polymeric composition that is made semi-conductive by introducing a conductive material. The polymer composition for the semi-conductive layer may be made of a thermoplastic. The thermoplastic may be made from at least one thermoplastic polymer, crosslinked or non-crosslinked, branched or linear, such as low density polyethylene (LDPE), linear low density polyethylene (LLDPE), medium density polyethylene (MDPE), ethylene vinyl acetate (EVA), or mixtures thereof. The polymers may be of "double percolation" thermoplastic or thermoset (crosslinked) materials, as described above with respect to inner semi-conductive layer 14.

Conductive materials that may be used in semi-conductive layer 24 include, for example, electrically conductive carbon black such as acetylene black or furnace black. If carbon black is used, it generally has a surface area of greater than 20 $m^2/g$, for example ranging from 40 to 500 $m^2/g$, as measured using the well-known BET test methodology. It is also possible to use a highly conductive carbon black with a greater surface area. Examples include furnace black, known commercially as KETJENBLACK® EC (Akzo Chemie NV), having a surface area of at least 900 $m^2/g$ under the BET test and BLACK PEARLS® 2000 (Cabot Corporation) having a surface area of 1500 $m^2/g$ under the BET test.

The amount of carbon black to be added to the polymeric matrix for semi-conductive layer 24 may vary as a function of the type of polymer and of carbon black used. Typically, the amount of carbon black may range from 5 to 80%, for example ranging from 10 to 70% by weight relative to the weight of the polymer.

Semi-conductive layer 24 also may provide sunlight resistance for cable 110. For example, UV additives can be included in the polymer for layer 24. Alternatively or in addition, the thickness of semi-conductive layer 24 may preferably be up to 20% of the overall thickness of the jacket (that is, the combined thickness of layers 24 and 22), to impart sunlight resistance according to ICEA standard S-108-720-2004. Preferably, semi-conductive layer 24 is at least 10 mils (0.254 mm) thick to assist with sunlight resistance. In applications without the need for added sunlight resistance, semi-conductive layer 24 need only be sufficient in thickness as to cover the outer surface of jacket 22 and to provide the conductivity function required for a DC withstand test.

With semi-conductive layer 24 being black and underlying jacket 22 being non-black, a field technician will be able to more readily distinguish between the two materials compared to when they are both conventionally black in color. Consequently, inadvertent damage to jacket 22 can be avoided when preparing for jacket integrity tests.

In addition, semi-conductive layer 24, or alternatively jacket 22, may be made texturally distinguishable from adjacent layers by being an expanded polymeric layer. The expression "expanded polymeric layer" in this context means a layer of polymeric material in which is provided a predetermined percentage of "free" space, that is to say of space not occupied by the polymeric material, but instead by gas or air. In this process, a foamed material is extruded for layer 22 or 24, which results in a material having a rougher feel by touch due to its cellular structure from expansion than a compact polymeric layer. The expression "compact polymeric layer" in this context means a layer of non-expanded polymeric material, that is to say a material with a zero degree of expansion.

The expanded semi-conductive polymeric layer is obtained from an expandable polymer optionally subjected to crosslinking after expansion. The expandable polymer may be chosen from the group comprising: polyolefins, various olefin copolymers, olefin/unsaturated ester copolymers, polyesters, polycarbonates, polysulphones, phenolic resins, urea resins, and blends thereof. Examples of suitable polymers are: polyethylene (PE), in particular low density polyethylene (LDPE), medium density polyethylene (MDPE), high density polyethylene (HDPE) and linear low-density polyethylene (LLDPE); polypropylene (PP); ethylene/propylene elastomeric copolymers (EPM) or ethylene/propylene/diene terpolymers (EPDM); natural rubber; butyl rubber; ethylene/vinyl ester copolymers, for example ethylene/vinyl acetate (EVA) copolymers; ethylene/acrylate copolymers, in particular ethylene/methyl acrylate (EMA), ethylene/ethyl acrylate (EEA), ethylene/butyl acrylate (EBA) copolymers; ethylene/a-olefin thermoplastic copolymers; polystyrenes; acrylo-nitrile-butadiene-styrene (ABS) resins; halogenated polymers, such as polyvinyl chloride (PVC); polyurethane (PUR); polyamides; aromatic polyesters, for instance polyethylene terephthalate (PET) or polybutylene terephthalate (PBT); and copolymers or mechanical blends thereof.

The expansion may take place either chemically, by using an expanding agent that may generate a gas under a given pressure and temperature conditions, or physically, by injecting a gas at high pressure into an extruder cylinder.

Foams are prepared by treating a polymeric material with a foaming agent, for example based on an azodicarbonamide, or others known in the art. Possible foaming or expanding agents include: azodicarbamide, para-toluene sulphonyl hydrazide, mixtures of organic acids (for example citric acid) with carbonates and/or bicarbonates (for example sodium bicarbonate), and the like.

Examples of gases that may be injected at high pressure into the extruder cylinder are: nitrogen, carbon dioxide, air, low-boiling hydrocarbons, for example propane or butane, halohydrocarbons, for example methylene chloride, trichlorofluoromethane, 1-chloro-1,1-difluoroethane, and the like, or mixtures thereof.

At the end of the extrusion step, the materials may be crosslinked according to known techniques, such as by using peroxides or via silanes.

In this case where the semi-conductive polymeric layer is expanded, the amount of carbon black present in the polymeric matrix may also vary as a function of the chosen expansion degree and of the expanding agent used.

In an electrical cable as depicted in FIG. 1 with an outer semi-conductive layer 24 formed of a foamed or expanded polymeric black material while jacket 22 is formed of a non-foamed or compact polymeric non-black material, semi-conductive layer 24 can be more readily distinguished from jacket 22 by a field technician by touch as well as by color. Similarly, when jacket 22 is foamed and outer semi-conductive layer 24 is non-foamed, the two layers may be distinguishable from each other by both touch and color. The technician should then be able to remove the thin semi-conductive layer 24 without damaging jacket 22.

Figure 2:
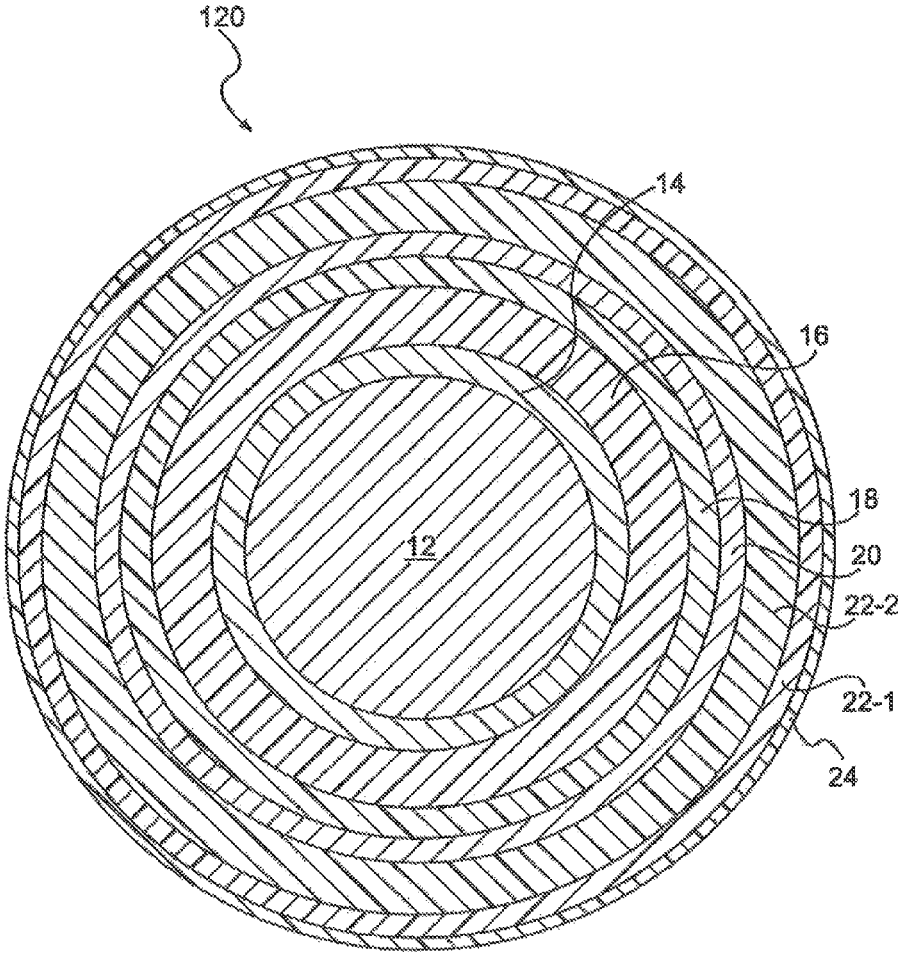
FIG. 2 is a cross-sectional view of an electrical cable having a three-layer sheath, consistent with certain disclosed embodiments.

FIG. 2 illustrates another embodiment of an electrical power cable 120. The construction of cable 120 is similar to that depicted for cable 110 in FIG. 1 except the jacket 22 of the cable has at least two polymeric layers. In particular, jacket 22 includes a first non-conductive layer 22-1 and a second non-conductive layer 22-2. Non-conductive layer 22-1 is the outermost layer of jacket 22 and is positioned directly beneath outer semi-conductive layer 24. Non-conductive layers 22-2 and 22-1 serve as a two-layer jacket 22 for cable 120. The three layers 22-2, 22-1, and 24 of the cable sheath are formed by extrusion and preferably are triple-extruded essentially simultaneously.

As in cable 110 of FIG. 1, outer semi-conductive layer 24 in cable 120 of FIG. 2 may be different and distinguishable from its immediately underlying layer by color and texture. In one embodiment, the outer semi-conductive layer 24 and the jacket layer 22-2 are both black in color, while the intermediate non-conductive layer 22-1 is non-black, such as a natural color. The non-conductive layer 22-1 may comprise the same material or materials as the jacket layer 22-2, except for color. Similarly, the material of non-conductive layer 22-1 should be compatible with the jacket layer 22-2 and outer semi-conductive layer 24, such that the three layers bond when extruded together.

As with other embodiments described above, a field technician will thus be able to visually distinguish between the outer semi-conductive layer 24 and the material immediately underneath it, which in this embodiment is a separate layer 22-1. The technician will therefore be able to remove the outer semi-conductive layer 24 without damaging the jacket layer 22-1. Outer semi-conductive layer 24 may additionally be made distinguishable from non-conductive layer 22-1 by texture by using a foamed material for layer 24 or 22-1, following the description provided above for other embodiments.

The method of manufacturing electrical power cables such as 110 and 120 may follow extrusion and cable manufacturing techniques known to those skilled in the art. In particular, the insulated cable core may be formed using conventional processes with materials, layers, and thicknesses chosen to comply with voltage requirements and needs of the particular application for the cable. Overall, a manufacturing method begins by forming an insulated cable core and advancing the insulated cable core through an extrusion cross-head. Extrusion of the various layers for the jacket follows, such as the co-extrusion of jacket 22 and semi-conductive layer 24 for cable 110 or of jacket layers 22-2 and 22-1, and semi-conductive layer 24 for cable 120.

The co-extrusion of semi-conductive layer 24 and jacket 22 as in cable 110 of FIG. 1 or the triple extrusion of layers 22-2, 22-1, and 24 of cable 120 of FIG. 2 may be done by using a single extrusion head or by using several extrusion steps in series (for example by means of the "tandem" technique). The co-extrusion or triple extrusion may also be done on the same production line intended for producing the insulated core or on a separate production line.

If semi-conductive layer 24 or jacket 22 is expanded, the expansion of the polymer may be carried out during the extrusion step performed on jacket 22. The aperture of the extruder head may have a diameter that is slightly less than the final diameter of the cable having the expanded coating which is desired to be obtained, such that the expansion of the polymer outside the extruder results in the desired diameter being reached.

If it is desired to produce a multipolar cable, for example of tripolar type, the process described for a unipolar cable may be suitably modified on the basis of the technical knowledge of a person skilled in the art.

Once completed, electrical cables 110 and 120 conventionally undergo checking according to conventional testing methods intended to evaluate the structural quality of the cable. These test include the DC withstand test discussed above to find any defects in jacket 22. Following this testing process (described in IEC Standard—Publication 229—Second Edition—1982 page 7 paragraph 3.1) involves applying, by means of a voltage generator, a preset DC voltage between semi-conductive layer 24 and metal layer 20 immediately below jacket 22. The structure of the jacket for cables 110 and 120 provide for easier and less destructive preparation of the cables for at least the DC withstand test.

EXAMPLE 1

A high voltage cable rated for 138 KV is provided with a Class B compressed copper conductor strand with a nominal cross-sectional area of 1500 KCM. Two semi-conducting tapes having 50% overlap are applied over the conductors. A further conductor shield layer of crosslinked semi-conducting material with minimum average thickness of 40 mils (1.02 mm) such as Borealis compound LE500 is extruded over the semi-conducting tapes.

Superclean crosslinked polyethylene, for example Borealis compound LE 4201 with minimum average thickness 755 mils (19.2 mm) is extruded over the conductor shield as an insulation layer. A crosslinked insulation shield such as Borealis compound LE0595 with a minimum point thickness of 40 mils (1.02 mm) and maximum point thickness of 100 mils (2.54 mm) is extruded over the insulation. Over the insulation shield is applied two water swellable semi-conducting bedding tapes intercalated with a 50% overlap. Extruded over the bedding tapes is a ½ c lead alloy sheath having a maximum average thickness of 120 mils (3.05 mm).

Over the metallic sheath is extruded a natural medium density polyethylene compound with a nominal thickness of 96 mils (2.22 mm). Over the natural jacket, and co-extruded with the natural jacket, is a black MDPE semi-conductive layer with a nominal thickness of 24 mils (0.61 mm). The semi-conductive layer is 20% of the thickness of the overall jacket, that is, 20% of the combined thickness of the natural jacket and the semi-conducting jacket, thus imparting sunlight resistance to the cable.

EXAMPLE 2

A high voltage cable rated for 138 KV according to the present embodiment is provided with a round segmented stranded and compacted copper conductor with an overall binder comprising one 5 mil copper tape intercalated with semi-conducting tape with a nominal cross-sectional area of 2500 KCM. Two semi-conducting tapes having 50% overlap are applied over the conductors. A second pair of semi-conducting tapes having 50% overlap are applied over the first pair of semi-conducting tapes. A further conductor shield layer of crosslinked semi-conducting material with minimum thickness of 30 mils (0.76 mm) such as Borealis compound LE500 is extruded over the semi-conducting tapes.

Superclean crosslinked polyethylene, for example Borealis compound LE 4201 with minimum average thickness 709 mils (18.0 mm) is extruded over the conductor shield as an insulation layer. A crosslinked insulation shield such as Borealis compound LE0595 with a minimum point thickness of 40 mils (1.02 mm) and maximum point thickness of 100 mils (2.54 mm) is extruded over the insulation. Over the insulation shield is applied two water swellable semi-conducting bedding tapes intercalated with a 25% overlap. Twenty-six #12 AWG solid bare copper wires are applied over the insulation shield as a concentric neutral layer. A bedding layer is applied over the concentric neutral layer and comprising one copper tape applied with a 1.0 inch gap, one water swellable tape intercalated 50% with on high strength semi-conducting tape. Over this bedding layer is applied a metal moisture barrier composed of one 8 mil (0.20 mm) aluminum tape applied longitudinally and folded.

A natural jacket, applied over and bonded to the metal moisture barrier comprises a natural extruded linear low density polyethylene with a minimum point thickness of 100 mils (2.54 mm) and a maximum point thickness of 148 mils (3.76 mm). Over the natural jacket, and co-extruded with the natural jacket, is a semi-conductive layer of a black linear low density polyethylene jacket with a minimum point thickness of 25 mils (0.64 mm) and a maximum point thickness of 37 mils (0.94 mm). The semi-conductive layer or jacket is 20% of the thickness of the jacket, that is, 20% of the combined thickness of the natural jacket and the semi-conductive jacket, thus imparting sunlight resistance to the cable.

It will be apparent to those skilled in the art that various modifications and variations can be made to the structure of the power cable disclosed herein without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrical cable, comprising:

an insulated core;

a jacket surrounding the insulated core, the jacket having at least an outermost polymeric layer;

a semi-conductive layer around the exterior of the cable in contact with the outermost polymeric layer of the jacket, the semi-conductive layer being different in color from the outermost polymeric layer of the jacket; and wherein a thickness of the semi-conductive layer is nominally 20% of a combined thickness of the jacket and the semi-conductive layer to improve sunlight resistance for the cable.

2. The electrical cable of claim 1, wherein the insulated core comprises a metallic conductor, an inner semi-conductive shield surrounding the conductor, a layer of extruded insulation around the inner semi-conductive shield, an intermediate semi-conductive shield around the extruded insulation, and a metallic screen surrounding the intermediate semi-conductive shield.

3. The electrical cable of claim 2, wherein the electrical cable is a multipolar cable having more than one conductor within the insulated core.

4. The electrical cable of claim 1, wherein the jacket comprises one of low density polyethylene (LDPE), medium density polyethylene (MDPE), high density polyethylene (HDPE), polyvinyl chloride (PVC), and a low smoke zero halogen (LSOH) material.

5. The electrical cable of claim 1, wherein the jacket comprises two polymeric layers, one being an innermost polymeric layer and another being the outermost polymeric layer, the innermost polymeric layer being the same color as the semi-conductive layer.

6. The electrical cable of claim 1, wherein the semi-conductive layer is black, and the outermost polymeric layer is a color other than black.

7. The electrical cable of claim 6, wherein the outermost polymeric layer is a natural color polymeric layer without the addition of colorants.

8. The electrical cable of claim 1, wherein the semi-conductive layer comprises at least a thermoplastic polymer chosen from one of the following: low density polyethylene (LDPE), linear low density polyethylene (LLDPE), medium density polyethylene (MDPE), and ethylene vinyl acetate (EVA).

9. The electrical cable of claim 1, wherein the semi-conductive layer is a color other than black, and the outermost polymeric layer is black.

10. The electrical cable of claim 9, wherein the semi-conductive layer is a material selected from the group of conductive polymers consisting essentially of polyaniline, polypyrrole and polyacetylene.

11. The electrical cable of claim 1, wherein the semi-conductive layer includes UV additives to improve sunlight resistance for the cable.

12. The electrical cable of claim 1, wherein the semi-conductive layer is a foamed material.

13. The electrical cable of claim 1, wherein the semi-conductive layer has a surface texture rougher than the outermost layer of the jacket.

14. The electrical cable of claim 1, wherein the outermost layer of the jacket is a foamed material.

15. The electrical cable of claim 1, wherein the outermost layer of the jacket has a surface texture rougher than the semi-conductive layer.

16. The electrical cable of claim 1, wherein the semi-conductive layer has a thickness of at least 10 mils.

* * * * *